US011319745B1

(12) United States Patent
Tobias et al.

(10) Patent No.: US 11,319,745 B1
(45) Date of Patent: May 3, 2022

(54) SYSTEM FOR MONITORING STATUS OF A PROTECTED SPACE OF A CONTAINER

(71) Applicants: Marc Tobias, Pittsburgh, PA (US); Tobias Bluzmanis, Miramar, FL (US)

(72) Inventors: Marc Tobias, Pittsburgh, PA (US); Tobias Bluzmanis, Miramar, FL (US)

( * ) Notice: Subject to any disclaimer, the term of this patent is extended or adjusted under 35 U.S.C. 154(b) by 203 days.

(21) Appl. No.: 16/824,816

(22) Filed: Mar. 20, 2020

Related U.S. Application Data

(60) Provisional application No. 62/871,807, filed on Jul. 9, 2019.

(51) Int. Cl.
*E05G 1/10* (2006.01)
*E05G 1/00* (2006.01)
*E05G 1/026* (2006.01)

(52) U.S. Cl.
CPC ..... *E05G 1/10* (2013.01); *E05G 1/005* (2013.01); *E05G 1/026* (2013.01)

(58) Field of Classification Search
CPC ... E05B 1/00; E05B 1/005; E05B 1/10; E05B 1/026; E05G 1/00; E05G 1/005; E05G 1/10; E05G 1/026
See application file for complete search history.

(56) References Cited

U.S. PATENT DOCUMENTS 5,381,685 A 1/1995 Carl
5,667,187 A 9/1997 Doman
6,040,771 A * 3/2000 Kim ..... E05G 1/10 340/545.1
6,305,656 B1 10/2001 Wemyss
6,552,650 B1 4/2003 Gokcebay
7,034,654 B2 4/2006 Forest
7,116,224 B2 * 10/2006 Mickler ..... G08B 13/1436 340/568.1
7,958,758 B2 6/2011 Trempala
8,122,746 B2 2/2012 Hyatt, Jr.
8,203,090 B2 * 6/2012 King ..... H01H 9/0271 200/303
8,749,382 B2 * 6/2014 Sterzinger ..... E05G 1/10 340/541
9,316,039 B2 * 4/2016 Stevenson ..... E05G 1/04
9,695,617 B2 * 7/2017 Bacarella ..... E05G 1/026
9,797,680 B2 * 10/2017 Hyde ..... F41C 33/041
10,362,889 B2 * 7/2019 Dehner ..... E05G 1/005
10,395,493 B1 * 8/2019 Simmons ..... G08B 13/149
10,403,122 B2 9/2019 Fawcett
(Continued)

FOREIGN PATENT DOCUMENTS

CA 2061455 8/1993
CA 2133743 10/1993

*Primary Examiner* — Christopher J Boswell
(74) *Attorney, Agent, or Firm* — Jeffrey A. Proehl; Woods, Fuller, Shultz & Smith, PC

(57) ABSTRACT

A system may include a container security apparatus for monitoring and communicating status information regarding a protected space in an interior of a container. The security apparatus may include a casing, a sensor assembly associated with the casing including at least one sensor configured to sense at least one condition in the interior of the container, a controller configured to receive sensor information from the sensor assembly and record the sensor information, and a communication assembly configured to communicate information from the controller including the sensor information.

20 Claims, 6 Drawing Sheets

(56) References Cited

U.S. PATENT DOCUMENTS

| | | | |
|---|---|---|---|
| 10,423,136 | B2 | 9/2019 | Davis |
| 2007/0229962 | A1 | 10/2007 | Mason |
| 2013/0316114 | A1 | 11/2013 | Hwang |
| 2014/0085773 | A1 | 3/2014 | Chernukhin |
| 2015/0242895 | A1 | 8/2015 | Brown |
| 2016/0343224 | A1 | 11/2016 | Markwell |
| 2016/0378140 | A1 | 12/2016 | Bergmann |
| 2017/0312578 | A1 | 11/2017 | Tran |
| 2021/0355741 | A1* | 11/2021 | Chiappetta ..... E05G 1/026 |

* cited by examiner

SYSTEM FOR MONITORING STATUS OF A PROTECTED SPACE OF A CONTAINER

REFERENCE TO RELATED APPLICATION

This application claims the benefit of the priority of U.S. Provisional Application No. 62/871,807 filed Jul. 9, 2019, which is hereby incorporated by reference in its entirety.

BACKGROUND

Field

The present disclosure relates to secure containers and more particularly pertains to a new system for monitoring the status and security of a protected space of a container and which may record sensed events for subsequent reference.

Description of the Prior Art

There is a prescription drug abuse epidemic in the United States which claimed at least 63,000 lives in 2017. The problem stems from unauthorized access to prescription medication, often by persons that have physical access to locations where prescription drugs are stored. Doctors, clinics, law enforcement agencies, pharmacies, drug manufacturers, and insurance companies are all concerned about the abuse of prescription drugs, especially controlled substances and the ability to easily access them and distribute them to unauthorized persons, especially children. Drugs are an attractive nuisance for children and teenagers and can result in overdose or death if abused. In many cases the medications are narcotics which can be extremely dangerous or lethal if improperly ingested, and the problem is compounded if these medications are taken to school and distributed.

The current response from the pain management medical community is to suggest the use of some form of prescription drug container that can be locked. The problem of designing a secure, small container for storing prescription medication, especially narcotics, is significant. Containers come in all sizes, forms, and materials. The problem is that none of the containers can be adequately secured at a reasonable price point, and many considerations limit the level of security of such containers. While many manufacturers produce supposedly secure containers, extensive testing has demonstrated that virtually all these lockboxes can be easily compromised, even by kids. A detailed analysis of the currently-available containers demonstrates that essentially none of the drug safes, containers, lockboxes, or similar designs provides any real measure of security and is also affordable by a majority of patients. Presently it is believed that there is no effective way to protect and deny access to unauthorized individuals and audit access without employing high security containers or safes, which are expensive.

Further, one of the most effective ways to control unauthorized access to the medications is to provide a simple, effective method to alert patients as to whether and when their medications have been accessed, and to provide an audit trail of those accesses. These measures tend to act as a deterrent to improper access and also alert the patient that pills or medication may have been taken from containers without their knowledge or permission. Without access detection and audit trails, the patient to whom medication has been prescribed often has no idea if pills or liquids have been improperly accessed or taken, especially by children in the same residence.

The present state of the art in drug containers is rudimentary and often employs inexpensive three or four-digit combination locks that can be very easily defeated with small screwdrivers or simply by applying pressure to the actuating or programming button that control the locks. Virtually all of them can be easily opened, often in a few seconds, with no tools, skill, or expertise in locks. Moreover, the use of any form of magnetic trips or traditional alarm sensors to detect when a container has been accessed is not feasible, given the wide range of designs and ability to easily incorporate and/or compromise these protective schemes. As a result, there is no simple and reliable means of electronically protecting small enclosed containers which are capable of triggering an alarm and making notifications if improperly accessed.

Current technology in the state-of-the-art alarm systems does not anticipate the monitoring and protection of very small spaces such as encountered within prescription drug containers and similar secure boxes because of several different technical issues. These include limited sensing range, radio frequency shielding in metal containers to block the transmission of RF signals, reliability of very low range commercial sensors, lack of very small self-contained integrated systems, and the inability to insert stand-alone sensors within a container irrespective of the orientation of sensing elements and normally-required mounting specifications, as the current invention can be inserted into a protected container as a separate, non-attached or mounted device that will sense intrusion, regardless as to how or where it is placed within the container or space to be protected.

Traditional alarm sensors, including passive infrared and motion detection are not feasible or applicable to remedy the monitoring of very small containers because they typically only have the capability of sensing an event, but not processing or performing audit, analysis, storage and notification. Alarm sensors that are incorporated within traditional alarm systems also require additional hardware and are not self-contained in a small package that can be inserted within a very limited-space container, such as medicine containers, cabinets, or other enclosures that store drugs, medication, alcohol, or other substances that have the potential of being abused by children or unauthorized individuals.

SUMMARY

The present disclosure relates to a system which may comprise a container security apparatus for monitoring and communicating status information regarding a protected space in an interior of a container. The security apparatus may include a casing, a sensor assembly associated with the casing including at least one sensor configured to sense at least one condition in the interior of the container, a controller configured to receive sensor information from the sensor assembly and record the sensor information, and a communication assembly configured to communicate information from the controller including the sensor information.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
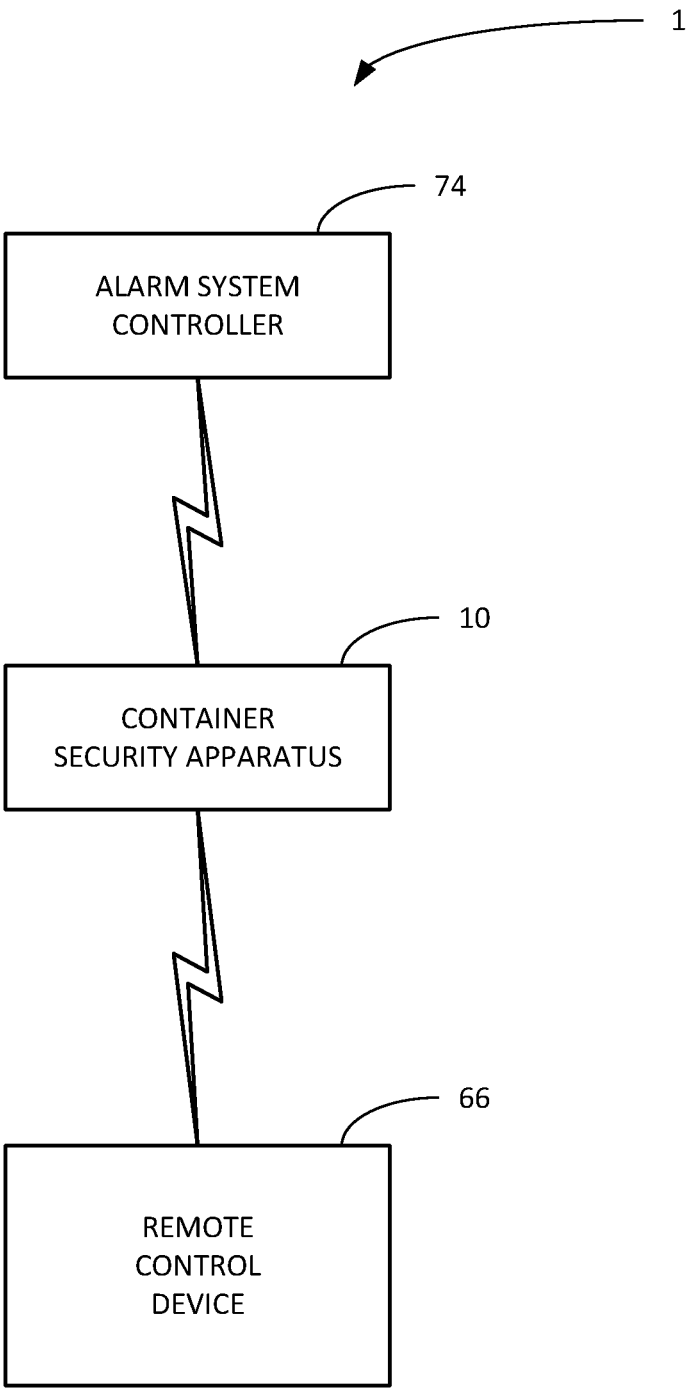
FIG. 1 is a schematic diagram of elements of the system, according to an illustrative embodiment.
Figure 2:
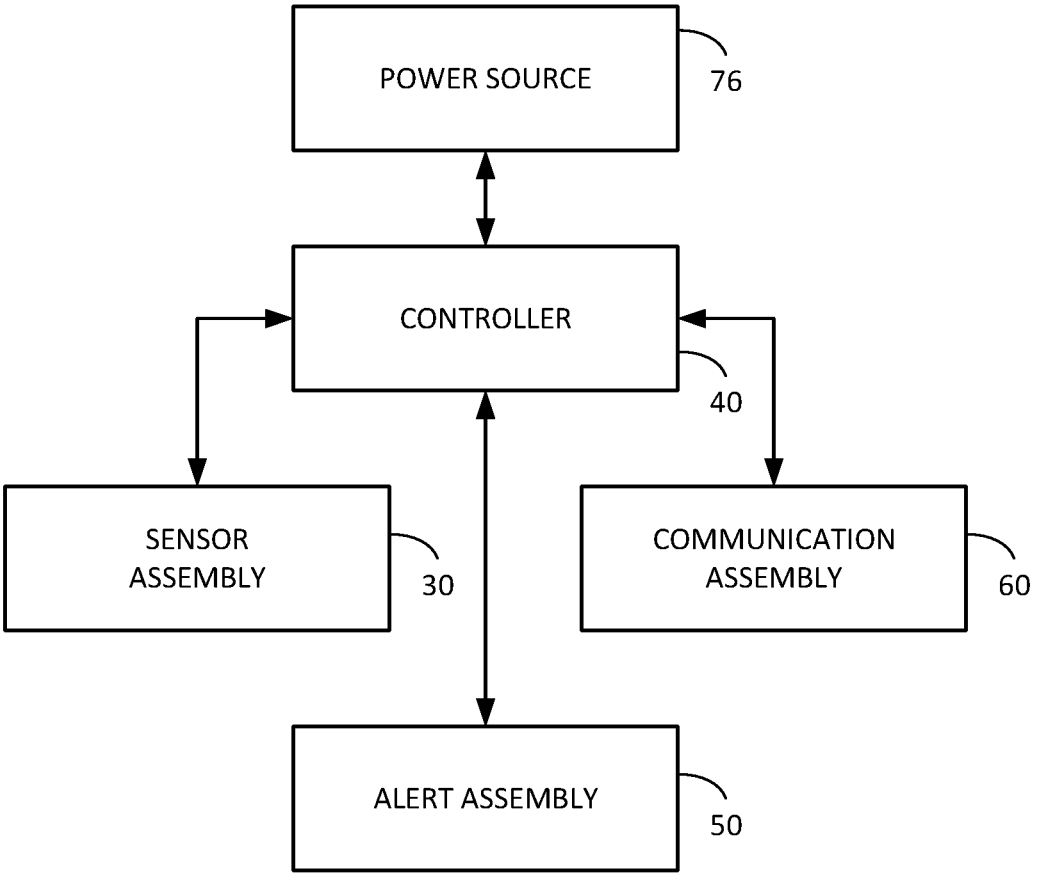
FIG. 2 is a schematic diagram of elements of the container security apparatus, according to an illustrative embodiment.
Figure 3:
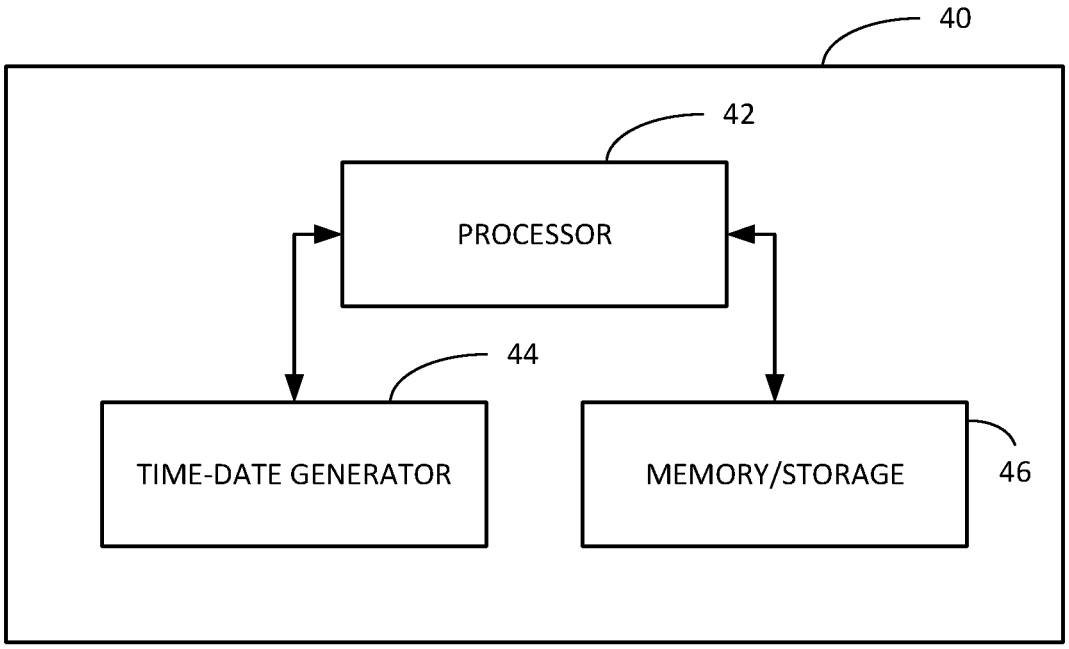
FIG. 3 is a schematic diagram of elements of the controller of the container security apparatus, according to an illustrative embodiment.
Figure 4:
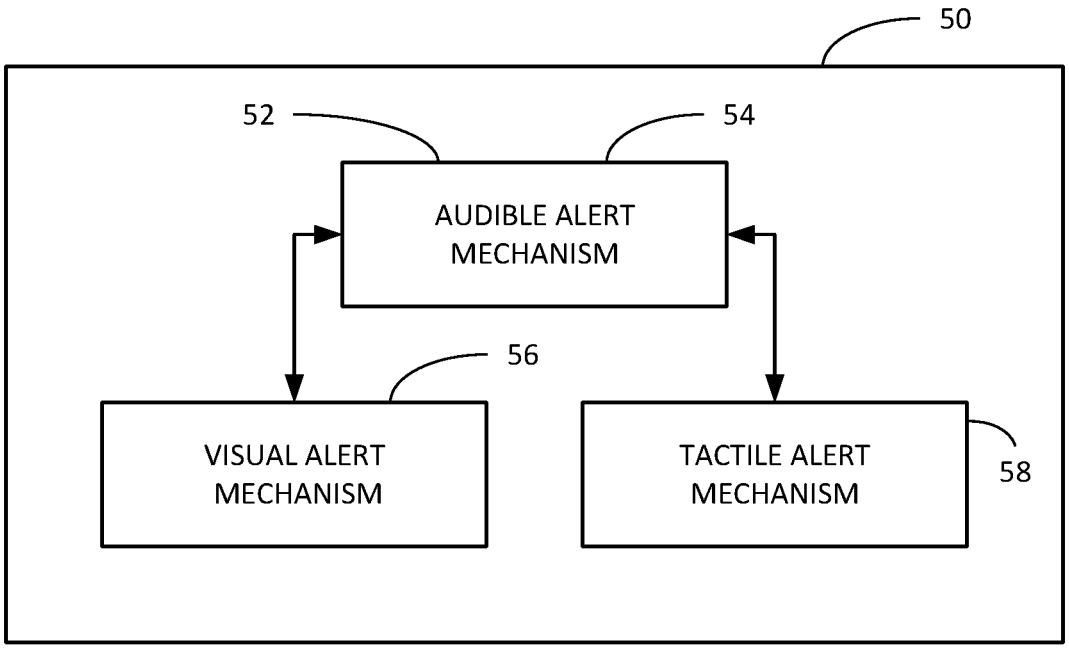
FIG. 4 is a schematic diagram of elements of the alert assembly of the container security apparatus, according to an illustrative embodiment.
Figure 5:
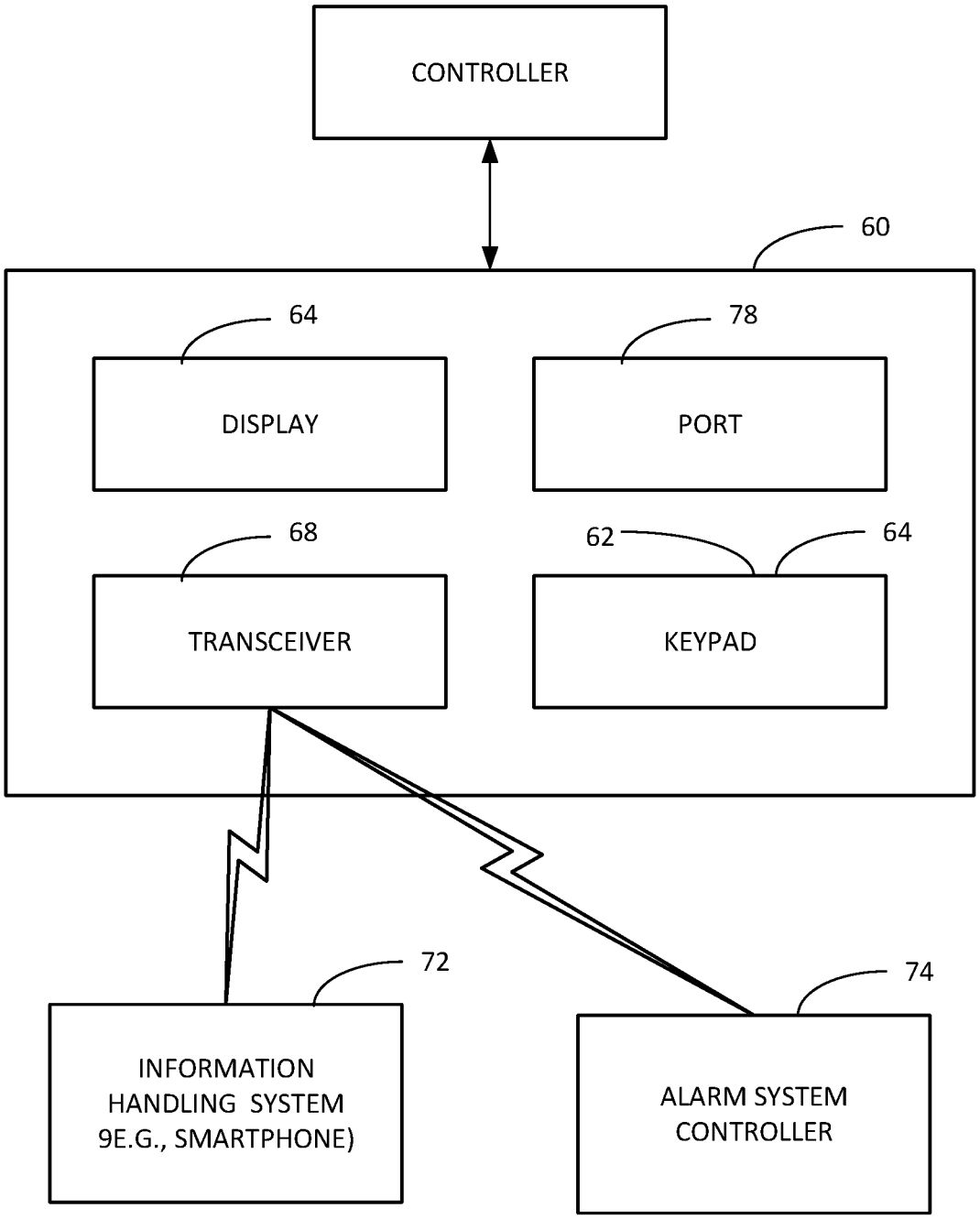
FIG. 5 is a schematic diagram of elements of the communication assembly of the container security apparatus, according to an illustrative embodiment.
Figure 6:
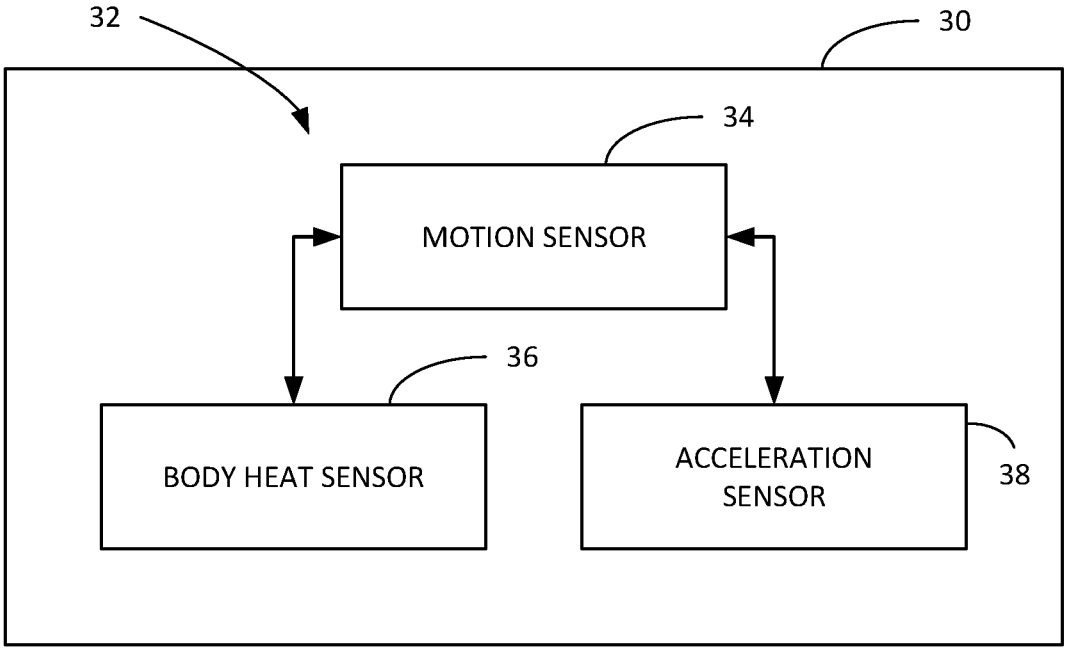
FIG. 6 is a schematic diagram of elements of the sensor assembly of the container security apparatus, according to an illustrative embodiment.
Figure 7:
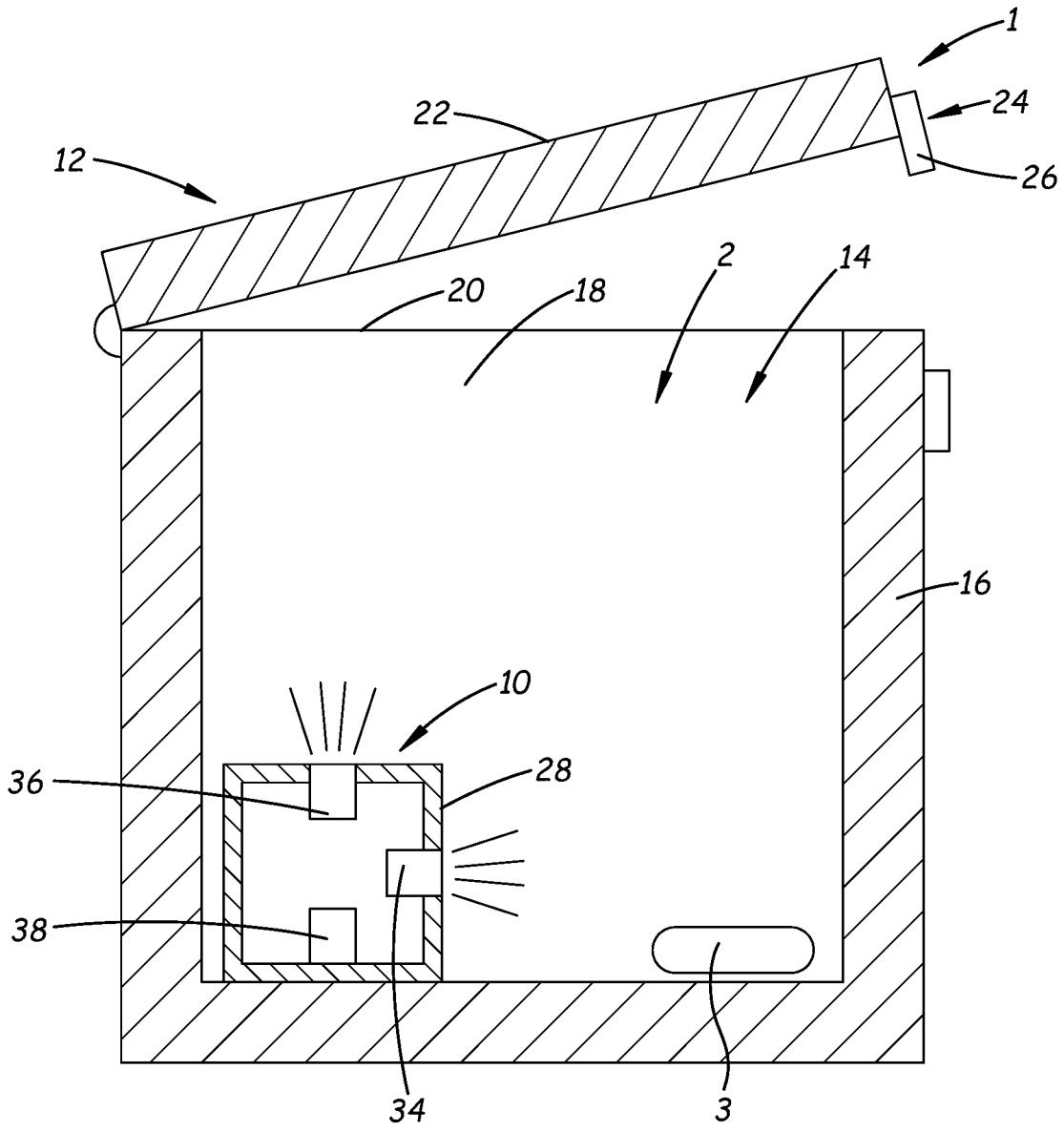
FIG. 7 is a schematic sectional view of an illustrative embodiment of the system of the present disclosure.

With reference now to the drawings, and in particular to FIGS. 1 through 7 thereof, a new system for monitoring status of a protected space of a container which embodies the principles and concepts of the disclosed subject matter will be described.

The applicants have devised a system which may provide an autonomous and self-contained mechanism that is able to monitor the interior of a container and the contents of the container, and may do so regardless of whether the container is closed or open. Embodiments of the apparatus disclosed may sense body heat and movement to sense an event, such as the accessing of the protected space of the container, and may send a message to another device, such as the base station of a security system and/or a device carried on the person of the user, such as, for example, a smartphone either directly or through the base station, in the form of a text message or an email message to alert the user of an access event which may be an intrusion into the container. The apparatus 10 is relatively small and can be easily placed within a small container such as a prescription drug container. The time and date of the occurrence of the access event may be recorded to provide a record of such events, or audit trail, to provide positive notification of any entry that may not have otherwise have been alerted to the user.

In one aspect, the disclosure relates to an alarm system 1 for monitoring status and communicating status information regarding a protected space 2 in which a protected object 3 is or will be located. The protected object 3 may be, for example, a pill or tablet (or multiple pills or tablets) of medication, or in some cases may be a pharmacy-provided container such as a "pill bottle" in which is contained tablets of medication. The protected space 2 is typically the interior of a container, and one illustrative example of a container in which is stored one or more "pill bottles" for holding medications. Such status information for the protected space may include, for example, access events in which objects in the protected space are accessed by opening a container defining the protected space in order to enable or provide access to the contents, such as a protected object 3, in the protected space. Such monitoring of the protected space may provide real-time (or substantially contemporaneous) alerts regarding an access event as well as recording information regarding the access event accessible after the event which may be useful for controlling the dispensing of the contents, such as tablets of strictly controlled medications which may have a high likelihood of being abused.

The alarm system 1 may include a container security apparatus 10 which is configured for monitoring and/or communicating the status information regarding the protected space defined by a container 12 and in which the protected object or objects are located. The security apparatus 10 may be configured to be positionable in the interior of the container without having to be integrated with the container itself in order to monitor conditions within the interior from the interior of the container. By monitoring the conditions and events occurring within the container interior, the apparatus 10 may effectively monitor other objects within the container (such as medication tablets) to permit detecting accesses or attempted accesses to the interior of the container and permitting recording of those detected accesses to thereby provide the ability to monitor the objects in the container interior. Advantageously, the security apparatus 10 may be utilized in a variety of different types and sizes of containers, as well as being transferable between different containers as the need to monitor the contents of different containers arises.

An illustrative container 12 suitable for use with the container security apparatus 10 may define an interior 14 which is configured to receive and hold at least one object, such as illustratively one or more tablets of medication, although other types of objects for which such monitoring functionality is desired may also be positioned in the container interior 14 and various different types of objects may be positioned in the interior 14 at same time. Optionally, the container interior 14 may be configured to accept an entire pill container or bottle in the interior. The container interior may have a variety of sizes selected for suitability of accommodating the size of the particular protected object or objects to be monitored. Illustratively, the interior 14 of the container 12 may measure less than approximately 15 inches in each perpendicular dimension.

In an illustrative embodiment, the container 12 may include a body 16 which defines a cavity 18 capable of at least partially receiving the object to be held in the protected space of the apparatus 10. Illustratively, the cavity 18 may define a majority of the interior 14 of the container and the protected space, but in other configurations the cavity 18 may define a smaller fraction of the interior 14. The body 16 may define an opening 20 into the cavity 18 through which contents to be placed in the protected space are moved prior to closure of the container and initiation of the protective features of the apparatus 10. Typically, although not necessarily, the opening 20 may be located toward one end of an elongated body 16. In the illustrative embodiments, the body 16 is formed by a perimeter wall of substantially cubic or cylindrical shape, although other configurations for the body 16 may also be utilized.

The container 12 may also include a lid 22 which may be removably mounted on the body 16 to close the opening 20 on the body and effectively prevent removal of objects from the protected space of the apparatus 10 and the cavity of the body when the lid 22 is mounted on the body. Conversely, when the lid 22 is not mounted on the body 16, and does not obstruct the opening, the lid does not effectively prevent removal of objects from the cavity of the body. A securing structure 24 may be configured to removably secure the lid 22 to the body 16 in a closed condition. Illustratively, the securing structure may include a hinge and a latch, which may provide a locking or lockable function, although other structures may be employed to secure the lid and body of the container together in a closed condition while permitting release, or partial release of the lid from the body to provide an open condition.

In greater detail, the container security apparatus 10 of the disclosure may provide a self-contained, miniaturized system that is convenient for everyday handling and use. An illustrative embodiment of the security apparatus 10 may include a casing 28 in which various elements of the apparatus 10 may be housed. Typically the casing 28 of the apparatus 10 is configured to be locatable in the interior of a container, such as the interior 14 of the illustrative container 12, but is not integrally mounted on the container such that the apparatus 10 may be freely movable into and out of the interior 14, and moved between containers, although in some less advantageous implementations the casing may be connected to the container 12. The casing 28 may form at least a partial enclosure for elements of the security apparatus 10 such as the sensor assembly 30 which is configured to sense or detect various conditions present in the protected space in the interior 14 of the container, or even conditions of the container 12 itself. The exterior of the casing 28 should be of a size suitable to permit the casing to be moved into an out of a container which defines the protected space such as through the opening 20 in the body. Illustratively, the casing may have a maximum width in any direction of less than approximately two inches although smaller sizes may be utilized and may be desirable for greater flexibility of use with containers of smaller sizes. Optionally, casings having sizes somewhat larger may also be utilized but are likely to be able to be utilized with smaller and more compact containers.

The sensor assembly 30 may include at least one sensor, and in some implementations the assembly 30 may include an array 32 of sensors for sensing two or more conditions. The sensor or sensors of the sensor array may be positioned in the casing 28 such that all of the sensor functions of the sensor assembly may be conducted from the same casing rather than, for example, separate and distinct casings. The sensors of the sensor assembly 30 may have a field or range of view that extends from the surface of the casing through, for example, an aperture in the casing or a window in the casing. Typically, although not necessarily, the sensors of the sensor array may be optimized for effectiveness over relatively short distances, such as the relatively small distances likely to be encountered within the interior of a container of the type contemplated in this disclosure.

In some embodiments, the sensors of the sensor assembly 30 may include a motion sensor 34 which is configured to detect motion within the interior 14 of the container in which the casing 28 of the apparatus 10 is positioned, such that the container interior 14 becomes a protected space. The motion sensor 34 may be positioned in the interior of the casing 28 in a manner that permits the motion sensor to communicate with the container interior 14 (such as through an aperture in the casing) and detect motion occurring in the container interior 14. The motion sensor 34 is thus able to sense movement of the protected object or objects in the protected space of the interior. Optionally, more than one motion sensor 34 may be utilized if necessary to enhance the coverage for motion detection such as by positioning motion sensors at multiple locations and/or sides of the casing.

The sensors of the sensor assembly 30 may also include a body heat sensor 36 which is configured to detect a change in heat detected in the interior space. Such a change in heat may be caused, for example, by movement of a human body part in or into the container interior 14 resulting from the human body part reaching into the interior 14 to move or remove (or attempt to move or remove) a protected object within the protected space. As an option, more than one body heat sensor 36 may also be utilized for the security apparatus 10 to enhance the sensing abilities of the sensor assembly 30.

Another illustrative sensor which may be a part of the sensor assembly 30 is an accelerometer sensor 38 which is configured to detect movement or motion of the security apparatus, and by extension when the apparatus 10 is positioned in the interior of the container, the container itself, in addition to those sensors intended to detect movement within the container interior 14. For example, movement of the container 12 from a resting condition on one surface to another surface, or carrying the container from one location to another, may be detected by the accelerometer sensor regardless of the container being opened and the container interior being accessed. Various suitable technologies may be utilized for these or other sensors which enable the sensor or sensors to produce a signal when the sensor has sensed or detected the condition or circumstance, or a change in the condition being sensed.

The container security apparatus 10 may also include a controller 40 which is generally configured to control operation of the apparatus and may be in communication with various elements of the apparatus, such as the sensor assembly 30. The controller 40 may include a processor 42 for receiving and processing signals from various elements of the apparatus 10, such as from sensors of the sensor assembly, or various inputs or instructions to the controller. The controller 40 may also include a time and date generator 44 capable of identifying the time and date of the receipt of a signal, such as an event signal, from an element of the apparatus (such as a sensor of the sensor assembly) to provide a timestamp for the event being signaled to the controller. The controller 40 may also include memory or storage 46 for receiving and storing data collected by the controller, such as the occurrence of events and the time of the occurrence of the events.

The controller 40 may perform various functions for the apparatus 10 which may include receiving event signals or other data from various sensors, processing the event signals to record data regarding the event signals such as the date and time of the occurrence of the event forming the basis of the signal, and communicate information regarding the event signals to other devices, such as elements that produce an alert and/or convey such information to a user of the apparatus 10.

The security apparatus 10 may also include an alert assembly 50 which is configured to provide an alert when, for example, an event has been sensed by a sensor of the sensor assembly or some other condition has been satisfied. The alert assembly 50 is in communication with the controller so as to be responsive to the controller to produce the alert when signaled by the controller. The alert assembly 50 may produce an alert in a manner that is perceptible by a person located proximate to or in the area of the container 12. The alert assembly 50 may include at least one alert mechanism 52 and in some embodiments may include more than one alert mechanism. Illustratively, the alert mechanism of the alert assembly may comprise an audible alert mechanism 54 which produces an audible, or audibly perceptible, alert. An example of such an alert mechanism is a buzzer or speaker or other device that is capable of creating a sound. The alert mechanism may comprise a visual alert mechanism 56 which produces a visual, or visually perceptible, alert. An example of such an alert mechanism is a light emitting device, such as a bulb or light-emitting diode, which produces illumination. The alert mechanism may comprise a tactile alert mechanism 58 which produces a tactile, or tactilely perceptible, alert. An example of such an alert mechanism is a vibrator or vibration producing element which may cause the casing to move or vibrate. In some implementations, more than one of the alert mechanisms may be incorporated in the apparatus 10.

The security apparatus 10 may also include a communication assembly 60 which enables the apparatus 10 to receive and communicate information or data to facilitate operation of the apparatus. The communication assembly 60 may be in communication with the controller 40 to permit information received by the communication assembly to be transmitted to the controller as input, as well as allowing information generated by the controller to be communicated to elements external to the apparatus 10 as output. In some embodiments, the communication assembly 60 may include an input device 62 for receiving input from the user. Illustratively, the input device 62 may comprise a keypad 64 which may be located, for example, on the casing 28. In other embodiments, the input device 62 may also (or alternatively) be located at least partially remote from the container, such as through a remote control device 66. The communication assembly 60 may include wireless communication circuitry permitting the communication assembly, and the controller via the communication assembly 60, to communicate with other elements of the system or other systems.

The remote control device 66 may be configured to wirelessly transmit control instructions to the controller via the communication assembly 60, such as via a transceiver 68 of the assembly 60. Any suitable wireless transmission technology as well as any suitable communication protocol may be utilized between the remote control device 66 and the transceiver 68, and the suitability of the particular transmission technology in communication protocol may depend upon the nature of the remote control device 66. For example, in some implementations, the remote control device 66 may comprise an information handling device 72 which has data communication capabilities, and may also have voice communication capabilities, such as a cellular telephone which incorporates data processing capabilities, commonly referred to as a "smartphone." A software application, or "app," stored and operating on the smart phone may provide a graphical user interface (GUI) for monitoring the apparatus 10 and also for operating the apparatus. In other implementations, the remote control may be of the type used to control other devices, such as, for example, a television remote control.

Suitable wireless transmission technologies may include those technologies intended for relatively short distance transmissions, such as, for example, Bluetooth wireless communication technology, near field communication (NFC) communication technology, radio frequency identification (RFID) communication technology, and the like. Suitable wireless transmission technologies intended for relatively longer distance transmissions may also be utilized, such as, for example, Wi-Fi (governed under the IEEE 802.11 standard) as well as other similar communication technologies and protocols.

Further, the communication assembly 60 may provide communication functionality to other types of apparatus such as alarm systems designed to monitor security aspects of a structure such as a home or residence. The communication assembly 60 may communicate with an alarm system controller 74 of the alarm system, and may be configured to communicate with the alarm system as another sensor in the network of sensors utilized by the alarm system. As such, the apparatus 10 may be able to utilize the functionality of the alarm system to produce a notification to the user via the alarm system (such as an audible alert). Additionally, the status of the container security apparatus 10 may be monitored via the alarm system controller 74 to provide information regarding the current status of the apparatus 10 as well as providing information regarding current and past alerts, and may serve as an output for information stored by the apparatus 10. Further, commands may be transmitted from the alarm system controller 74 to the container security apparatus 10 in order to set the status and various operational conditions for the apparatus 10 via the communications link.

The container security apparatus 10 may additionally include a power source 76 to store and provide electrical energy to elements of the apparatus 10 for operation of those elements such as, for example, the controller 40 as well as the communication assembly 60 and the alert assembly 50. The power source 76 may comprise a rechargeable battery which is positioned in the casing, and optionally a port 78 may be provided which is in communication with the power source 76 in order to recharge a rechargeable battery. The port 78 may be located on the casing of the apparatus 10 which contains the power source. The port 78 may have any configuration suitable for transmitting electrical energy to the power source. In some embodiments, the port 78 may have a configuration conforming to the universal serial bus (USB) standard which not only permits the transfer of electrical power to the power source, but may also provide a signal path for wired communication to elements of the apparatus 10 such as the controller 40. In other embodiments, other technologies for recharging the battery may be utilized, such as wireless inductive charging.

Optionally, a display 80 may be provided to display various information regarding the apparatus 10, such as providing an indication of the operating status of the apparatus. The display 80 may be located on casing 18. In some implementations, manipulations of the keypad 64 may be used to change the information displayed on the display 80, such as switching or toggling between entries of time and date for accesses to the contents of the apparatus 10 which may be stored in the memory storage 46.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A system comprising:

a container security apparatus for monitoring and communicating status information regarding a protected space of an interior of a container in which the container security apparatus is positioned, the apparatus comprising:

a casing for positioning within the protected space of the interior of the container;

a sensor assembly associated with the casing including at least one sensor configured to sense at least one condition in the interior of the container;

a controller configured to receive sensor information from the sensor assembly and record the sensor information; and a communication assembly configured to communicate information from the controller including the sensor information;

wherein the at least one sensor of the sensor assembly comprises a motion sensor configured to detect motion in the protected space of the interior of the container when the casing is positioned in the interior of the container.

2. The system of claim 1 additionally comprising a container having the interior defining the protected space, the container security apparatus being removably positioned in the interior of the container.

3. The system of claim 2 wherein the container comprises:

a body defining a cavity receiving a protected object, the cavity of the body further receiving the container security apparatus, the body defining an opening into the cavity; and a lid removably mounted on the body to close the opening when the lid is mounted on the body.

4. The system of claim 1 wherein the sensor assembly is integrated in the casing, the at least one condition of the container sensed by the sensor assembly being movement of the container.

5. The system of claim 1 wherein the sensor assembly is configured to generate at least one status signal corresponding to a status of the protected space.

6. The system of claim 1 wherein the motion sensor is positioned on the casing in a manner that permits the motion sensor to communicate with the interior of the container in which the casing is positioned to detect motion occurring in the interior of the container.

7. The system of claim 6 wherein the motion sensor is in communication with an aperture in the casing to permit the motion sensor to sense motion outside of the casing in the interior of the container when the casing is positioned in the container.

8. The system of claim 1 wherein the at least one sensor of the sensor assembly additionally comprises a body heat sensor configured to detect movement of a part of a human body part into the protected space of the container.

9. The system of claim 1 wherein the at least one sensor of the sensor assembly additionally comprises an accelerometer sensor configured to detect motion of the casing.

10. The system of claim 1 wherein the controller is in communication with the sensor assembly, the controller including a time-date generator and a storage configured to record a time and date of an event sensed by the sensor assembly.

11. The system of claim 1 wherein the container security apparatus additionally comprises an alert assembly configured to provide an alert, the alert assembly being in communication with the controller, the alert assembly being responsive to the controller to produce the alert.

12. The system of claim 11 wherein the alert assembly is configured to produce the alert in a manner perceptible in an environmental area of the container.

13. The system of claim 1 wherein the container security apparatus further comprises a power source configured to store and provide electrical energy to elements of the container security apparatus, the power source being integrated into the casing.

14. The system of claim 13 wherein the container security apparatus further comprises at least one port on the casing and configured to receive electrical energy for powering elements of the apparatus, the at least one port being in communication with the power source.

15. The system of claim 1 wherein the container security apparatus further comprises a display configured to display an indication of a status of the apparatus, the display being located on the casing and being in communication with the controller.

16. The system of claim 1 wherein the communication assembly includes wireless communication circuitry permitting the communication assembly to communicate wirelessly with other elements of the system.

17. The system of claim 1 wherein the communication assembly includes wireless communication circuitry permitting the communication assembly to communicate wirelessly with an alarm system controller of an alarm system.

18. The system of claim 1 wherein the communication assembly includes:

wireless communication circuitry permitting the communication assembly to communicate wirelessly; and a remote control device in wireless communication with the wireless communication circuitry of the communication assembly to communicate control commands to the controller of the container security apparatus.

19. The system of claim 1 wherein the sensor assembly comprises a plurality of the motion sensors with each of the motion sensors being positioned on a side of the casing to enhance motion sensing coverage of the protected space of the interior of the container.

20. A system comprising:

a container having a body with a cavity defining an interior of the container for receiving a protected object, the body defining an opening through which the protected object may be moved into and out of the interior; and a container security apparatus for monitoring and communicating status information regarding a protected space of the interior of the container, the container security apparatus being removably positioned in and movable about the interior of the container, the apparatus comprising:

a casing positioned in the protected space of the interior of the container;

a sensor assembly associated with the casing including at least one sensor configured to sense at least one condition in the protected space of the interior of the container;

a controller configured to receive sensor information from the sensor assembly and record the sensor information; and a communication assembly configured to communicate information from the controller including the sensor information;

wherein the at least one sensor of the sensor assembly comprises a motion sensor configured to detect motion in the protected space in the interior of the container in which the casing is positioned.

* * * * *